US009316454B2

(12) United States Patent
Milde, Jr.

(10) Patent No.: US 9,316,454 B2
(45) Date of Patent: Apr. 19, 2016

(54) SECURE SMARTPHONE-OPERATED GUN LOCK WITH MEANS FOR OVERRIDING RELEASE OF THE LOCK

(71) Applicant: Karl F. Milde, Jr., Mahopac, NY (US)

(72) Inventor: Karl F. Milde, Jr., Mahopac, NY (US)

( * ) Notice: Subject to any disclaimer, the term of this patent is extended or adjusted under 35 U.S.C. 154(b) by 0 days.

(21) Appl. No.: 14/513,344

(22) Filed: Oct. 14, 2014

(65) Prior Publication Data

US 2015/0184963 A1 Jul. 2, 2015

Related U.S. Application Data

(63) Continuation-in-part of application No. 14/140,658, filed on Dec. 26, 2013, now Pat. No. 8,931,195.

(51) Int. Cl.
*F41A 17/06* (2006.01)

(52) U.S. Cl.
CPC ..... *F41A 17/063* (2013.01); *F41A 17/066* (2013.01)

(58) Field of Classification Search
CPC ..... F41A 17/00; F41A 17/06; F41A 17/063; F41A 17/08; F41A 17/30; F41A 17/46
USPC ..... 42/70.11, 84, 70.01, 70.07, 70.06, 66
See application file for complete search history.

(56) References Cited

U.S. PATENT DOCUMENTS 3,939,679 A * 2/1976 Barker ..... E05B 47/068 341/181
5,461,812 A * 10/1995 Bennett ..... F41A 17/063 42/70.06
5,546,690 A * 8/1996 Ciluffo ..... F41A 17/066 340/5.52
5,675,925 A * 10/1997 Wurger ..... F41A 17/06 42/70.06
6,293,039 B1 * 9/2001 Fuchs ..... F41A 17/066 42/70.04
6,421,943 B1 * 7/2002 Caulfield ..... F41A 17/066 42/70.01
6,711,844 B2 * 3/2004 Rumfelt ..... F41A 17/063 42/70.11
8,049,597 B1 * 11/2011 Murakami ..... G06F 21/32 340/5.1
8,756,850 B2 * 6/2014 Dietel ..... F41A 11/02 42/70.11
2001/0042332 A1 * 11/2001 Gering ..... F41A 17/063 42/70.08
2002/0032976 A1 * 3/2002 Riener ..... F41A 17/063 42/70.11
2002/0112390 A1 * 8/2002 Harling ..... F41A 17/066 42/70.11
2004/0099134 A1 * 5/2004 Gotfried ..... F41A 17/066 89/1.11
2006/0242879 A1 * 11/2006 Schmitter ..... F41A 17/063 42/70.01
2006/0262480 A1 * 11/2006 Stewart ..... F41A 17/066 361/251

(Continued)

*Primary Examiner* — Joshua Freeman
(74) *Attorney, Agent, or Firm* — Karl F. Milde, Jr.

(57) ABSTRACT

A gun lock device, which may be configured to be disposed on or adjacent a gun to alternatively prevent or enable firing, includes a data receiver, a data memory and a logic device for determining whether a potential gun user's biologic data received by the receiver is the same, or substantially the same, as biologic data stored in the data memory. A separate smartphone is provided to collect and transmit the biologic data to the data receiver of the gun lock device. The logic device also responds to a gun control signal transmitted by the smartphone to lock the gun when the smartphone is located in a proscribed area, such as within a school zone or outside a secured area such as an airport or shopping mall.

3 Claims, 4 Drawing Sheets

(56) References Cited

U.S. PATENT DOCUMENTS

2007/0074438 A1* 4/2007 Parhofer ..... F41A 17/063 42/70.01
2008/0039962 A1 2/2008 McRae
2009/0064557 A1 3/2009 Hughes et al.
2009/0223104 A1* 9/2009 Anzeloni ..... F41A 17/063 42/70.06
2011/0030262 A1* 2/2011 O'Shaughnessy .... F41A 17/063 42/70.01
2011/0126622 A1* 6/2011 Turner ..... F41A 19/01 73/514.01
2012/0300988 A1* 11/2012 Ivanov ..... G06K 9/00006 382/115
2012/0329446 A1 12/2012 Dietel
2013/0167423 A1* 7/2013 Lupher ..... F41A 17/06 42/70.06
2013/0180147 A1* 7/2013 Lupher ..... F41A 19/58 42/69.01
2013/0332197 A1* 12/2013 Hinkel ..... G06F 19/3487 705/3
2014/0083318 A1* 3/2014 Templ ..... F41A 17/063 102/215
2014/0173961 A1* 6/2014 Goren ..... F41A 17/063 42/70.11
2014/0173962 A1 6/2014 Goren et al.
2014/0182179 A1* 7/2014 McHale ..... F41A 17/48 42/70.06
2014/0230296 A1* 8/2014 Kuparinen ..... F41A 17/063 42/1.01
2014/0239647 A1* 8/2014 Jadallah ..... E05C 19/002 292/140
2014/0259841 A1* 9/2014 Carlson ..... F41A 17/063 42/1.01
2014/0290109 A1* 10/2014 Stewart ..... F41A 17/08 42/70.01
2014/0290110 A1* 10/2014 Stewart ..... F41A 17/08 42/70.11
2014/0360073 A1* 12/2014 Stewart ..... F41A 17/08 42/70.11
2015/0040453 A1* 2/2015 Ballard ..... F41A 17/063 42/70.11
2015/0184962 A1* 7/2015 Burdine ..... F41A 17/063 42/70.11

* cited by examiner

SECURE SMARTPHONE-OPERATED GUN LOCK WITH MEANS FOR OVERRIDING RELEASE OF THE LOCK

CROSS-REFERENCE TO RELATED APPLICATION

This application claims priority from the following U.S. patent applications:

(1) Provisional Application No. 61/761,270, filed Feb. 6, 2013, entitled "SECURE SMARTPHONE-OPERATED GUN TRIGGER LOCK;"

(2) patent application Ser. No. 13/763,951, filed Feb. 11, 2013, entitled "SECURE SMARTPHONE-OPERATED GUN TRIGGER LOCK" (now U.S. Pat. No. 8,893,420);

(3) Provisional Application No. 61/841,559, filed Jul. 1, 2013, entitled "SECURE SMARTPHONE-OPERATED GUN LOCK;" and (4) patent application Ser. No. 14/017,666 filed Sep. 4, 2013, entitled "SECURE SMARTPHONE-OPERATED GUN TRIGGER" (now U.S. Pat. No. 8,919,024); and (5) patent application Ser. No. 14/140,658, filed Dec. 26, 2013, entitled "SECURE SMARTPHONE-OPERATED GUN LOCK WITH MEANS FOR OVERRIDING RELEASE OF THE LOCK" (now U.S. Pat. No. 8,931,195).

This application is a continuation-in-part of the aforesaid patent application Ser. No. 14/140,658.

To the fullest extent permitted by law, these applications are incorporated herein by reference.

BACKGROUND OF THE INVENTION

The present invention relates to a gun lock for a hand gun, such as a pistol or rifle, to prevent the owner or any other person who is authorized to use the gun from firing the gun at times when it is inappropriate or dangerous to do so.

Mechanical gun padlocks are designed to be installed on the guns in a position behind the trigger to block the trigger from moving rearward and firing the gun. Mechanical gun locks have also been installed within guns to prevent movement of the firing pin or other parts of the firing mechanism unless disabled with a key. Such gun locks use a physical key that can be easily duplicated, and the locks themselves can be compromised by means of a master key or a lock pick. These gun locks can therefore be opened by anyone in possession of one of the keys. With such gun locks it is not possible to restrict the use of the gun to the gun owner or to some other person who is licensed or otherwise authorized to use the gun.

The aforementioned U.S. patent application Ser. No. 13/763,951, filed Feb. 11, 2013 discloses a gun lock system which uses a "smartphone," such as an Apple "iPhone," with a suitable application ("phone app") as an electronic key to unlock the gun. The smartphone transmits biologic identification ("BioID") data about a person to an electronic lock on the gun which, in turn, matches it with pre-stored data and unlocks the gun if a proper match is found. This system allows only the gun owner (or some other person who is licensed or otherwise authorized), who has originally supplied their BioID data to the gun lock for storage, to use the gun. The system is difficult to compromise and yet allows the gun to be unlocked by any smartphone that can collect BioID data and transmit it to the gun. This system avoids the problem of unlocking a gun when the user's smartphone has been lost, stolen or broken or has been replaced by a new one.

Unfortunately, even the owner of a gun, or another person otherwise properly authorized to use the gun, may have the intention, as an act of anger, revenge, hostility, mental illness or the like, to use the gun inappropriately and thereby cause bodily harm or death to another human being. In such instances, it would be desirable to allow a second person, who may or may not also have his/her BioID data stored in the gun to allow his/her use of the gun, and who may or may not be the person in danger of bodily harm or death, to lock the gun and prevent its inappropriate use.

Also, within certain geographical areas, such as (1) in the vicinity of a school, place of worship or other location where people congregate, (2) near a particular person who, as a government official or other VIP, may be under a heightened danger of an act of gun violence, or (3) near a person that has obtained a protective order against someone else who has threatened violence, it would be desirable to prevent the operation of a gun.

Further, when a security officer is authorized to carry and use a gun within a prescribed area, such as an airport or a shopping mall, it would be desirable to prevent his/her use of the gun in any and all geographical areas outside of the prescribed area.

Moreover, it would be desirable to prevent the firing of a gun, even by the owner or another person otherwise properly authorized to use the gun, when such owner or authorized person is intoxicated or otherwise acting in less than a sane and sober manner.

It would also be desirable to prevent the firing of a gun in situations where the owner, or another person otherwise properly authorized to use the gun, has not planned in advance to make use of the gun. In this way, it may be possible to avoid unpremeditated uses of the gun that may occur in the so-called "heat of passion."

Finally, it would be desirable to override all of the aforementioned safety precautions in the case of imminent danger to a person in possession of a gun, where immediate use of the gun is necessary, such as when a hostile third party threatens bodily injury or even death.

SUMMARY OF THE INVENTION

An object of this invention, therefore, is to provide a gun, and a gun lock therefor, which enables another person, a GPS locater, a breathalyzer or other phone App based analyzer, and/or an "expert system" built into a gun lock, to lock the gun with priority over another person who is authorized to use the gun but who may attempt or does attempt to fire the gun inappropriately.

This object, as well as other objects which will become apparent from the discussion that follows, is achieved, in accordance with the present invention, by providing apparatus for locking and unlocking a gun to control its use, which comprises:

(a) a gun lock device configured to be disposed on a gun and responsive to at least one electric signal to select between two operative states, a locked state which prevents the gun from firing and an unlocked state which enables firing;

(b) a data receiver for receiving (1) a gun control signal that specifies one of a locked and an unlocked state, and (2) gun security data;

(c) a data memory for storing gun security data; and (d) a first logic device, coupled to the data receiver and to the data memory, for comparing gun security data received by the data receiver with gun security data stored in the data memory, and for producing the at least one electric signal to actuate the gun lock device in dependence upon the gun control signal and upon whether the stored gun security data and the received gun security data are substantially similar.

According to one important aspect of the invention, the first logic device is operative to cause the gun lock device to either enable the gun to be fired or to prevent the gun from being fired, if and only if the stored gun security data and the received gun security data are substantially similar. In this way, any person having a gun key capable of sending (1) a gun control signal that specifies one of a locked and an unlocked state, and (2) the gun security data, can control the operation of the gun.

The gun security data can comprise a pseudo-random number and/or it preferably includes data, such as biologic data, identifying a putative authorized person who wishes to control the operation of the gun.

The term "substantially similar" is intended to mean that the data are sufficiently similar to indicate a match. Biologic identification ("BioID") data obtained at different times about the same person are never exactly the same, however. Nevertheless, it is sufficiently similar to make it possible to determine with fair certainty whether such data, obtained at different times, identifies the same person.

According to another important aspect of the present invention, there is provided a first gun key device having a data transmitter for transmitting a first gun control signal and first gun security data to the data receiver. This first gun key device includes a second logic device, coupled to the data transmitter, for generating the first gun control signal and the first gun security data for transmission to the data receiver.

Advantageously, the first gun key device further comprises:

(a) a first input device, for inputting information from a putative authorized person who wishes to control the gun; and (b) a second logic device, coupled to each of the data transmitter and the input device, for generating the first gun security data defined by the putative authorised person for transmission to the data receiver.

The putative authorized person is recognized as a person authorized to control the gun in the event the first gun security data is substantially similar to the stored gun security data.

The information inputted by the putative authorized person may include a password chosen by the putative authorized person and/or biologic identifying information (BioID data), identifying the putative authorized person. In the latter case, the stored gun security data represent at least one biologic identifier of an authorized person. In a preferred embodiment of the invention, the first input device can include a first camera that is operative to record an image of the putative authorized person as a biologic identifier, this image being one or more of, for example:

a facial image;
an image of an iris;
a retinal image;
a fingerprint;
a palm print; and
an image of veins of a hand.

In this case the second logic device is operative to process the image and to generate the first gun security data therefrom.

In another preferred embodiment of the invention the first input device is a microphone, and the second logic device is operative to process a voiceprint of the putative authorized person as a biologic identifier and to generate the first gun security data therefrom.

In still another preferred embodiment of the invention, the first input device is a first alphanumeric keyboard. In this case, (i) the putative authorized person may input a first alphanumeric code; and (ii) the putative authorized person is recognized as an authorized person in the event the inputted code matches the stored data.

Advantageously, the first input device may comprise two or more of a camera, a microphone and a keyboard to capture the security data of the putative authorized person for processing by the second logic device and thus add security to the system.

According to still another important aspect of the present invention, there is provided a second gun key device having a data transmitter for transmitting a second gun control signal and second gun security data to the data receiver.

This second gun key device includes a third logic device, coupled to the data transmitter, for generating the second gun control signal and the second gun security data for transmission to the data receiver.

According to a preferred embodiment of the invention, the second and gun key device further comprises:

(a) a second input device, for inputting information from a putative authorized person who wishes to control the gun; and (b) a third logic device, coupled to each of the data transmitter and the input device, for generating the second gun security data defined by the putative authorized person for transmission to the data receiver.

The putative authorized person is recognized as a person authorised to control the gun in the event the second gun security data is substantially similar to the stored gun security data.

The information inputted by the putative authorized person may include both a password chosen by the putative authorized person and biologic identifying information, identifying the putative authorized person. In this case, the stored gun security data represent both a password and a biologic identifier (BioID data) of an authorized person.

In a preferred embodiment of the invention, second input device can include a second camera that is operative to record an image of the putative authorized person as a biologic identifier, this image being one or more of:

a facial image;
an image of an iris;
a retinal image;
a fingerprint;
a palm print; and
an image of veins of a hand.

In this case the second logic device is operative to process the image and to generate the second gun security data therefrom.

In another preferred embodiment of the invention, the second input device is a microphone, and the second logic device is operative to process a voiceprint of the putative authorized person as a biologic identifier and to generate the second gun security data therefrom.

In still another preferred embodiment of the invention, the second input device is a second alphanumeric keyboard. In this case, (i) the putative authorized person may input a first alphanumeric code; and (ii) the putative authorized person is recognized as an authorized person in the event the inputted code matches the stored data.

The information inputted by the putative authorized person may include both a password chosen by the putative authorized person and biologic identifying information, identifying the putative authorized person. In this case, the stored gun security data represent both a password and biologic identifier (BioID data) of an authorized person.

According to still another important aspect of the present invention, the first logic device responds to the second gun control signal transmitted by the second gun key device with priority over the first gun control signal transmitted by the first gun key device.

According to still another important aspect of the present invention, either the gun itself or a gun key device, or both, are provided with a GPS locater and the logic device in either the gun or in the gun key device, respectively, generates a gun control signal which locks the gun and prevents it firing while the gun and/or the gun key device is located inside a prescribed geographical area or, conversely, outside a prescribed geographical area, hereinafter referred to collectively as the "proscribed geographical area." In this proscribed area the gun is prevented from firing. The proscribed area might encompass a government building or a school zone, for example, or it might encompass an entire region outside of an area within which the firing of a gun is permitted by an authorized person, such as at an airport or shopping mall that a security officer has been hired to protect. In this way, the security officer is prevented from using his/her weapon unless he/she is on the designated premises.

In a particular embodiment of the invention, which prevents a gun from firing in the proscribed geographical area, the apparatus includes:

(1) a GPS locater device disposed near or on a gun for determining its location and producing a first signal representing the location of the gun;

(2) a mechanical locking member associated with the gun and movable between a locked position which prevents the gun from firing and an unlocked position which enables the gun to be fired;

(3) a logic device, coupled to receive the first signal, for producing a second signal indicative that the gun is within a proscribed geographical area; and (4) an electromechanical actuator, mechanically coupled to the locking member and electronically coupled to the logic device, for moving this member from the unlocked position to the locked position and for holding the locking member in the locked position as long as the gun remains in the proscribed geographical area.

In another embodiment of the invention which prevents a gun from firing when it is near a certain person (such as a VIP, the VIP's motor vehicle, or a person provided with a court order of protection), the apparatus includes two GPS locater devices, one with the gun and one with the person or motor vehicle, that provide GPS locater signals to the logic device. The logic device then determines when the gun is located within a prescribed distance from the protected person. When and if this occurs, the device causes the electromechanical actuator to move the locking member to its locked position and maintains the member in this position as long as the danger of gun violence continues to exist.

According to still another aspect of the present invention, there is provided a third and master gun key device having a third data transmitter and a fourth logic device, coupled to the third data transmitter, for transmitting a third gun control signal and third gun security data to the data receiver. The first logic device responds to the third gun control signal transmitted by the third gun key device with priority over any other gun control signal transmitted by any other gun key device.

According to still another aspect of the present invention, the first gun key device, which is preferably a smartphone, includes an application ("phone app") that checks the sobriety and sanity of the gun user and, under certain circumstances, requires the user to "plan ahead" and set a timer to enable use of the gun at some time prior to its being unlocked.

In a particular embodiment of this invention, which prevents a gun user from firing the gun while in a state of intoxication or other incapacity, the apparatus includes:

(1) a testing device for determining a level of intoxication or other incapacity of a person intending to use a gun and producing a first signal representing the level of incapacity;

(2) a mechanical locking member associated with a gun and movable between a locked position which prevents the gun from firing and an unlocked position which enables the gun to be fired;

(3) a logic device, coupled to receive the first signal, for producing a second signal indicative that the person's level of incapacity exceeds a prescribed level; and (4) an electromechanical actuator, mechanically coupled to the locking member and electronically coupled to the logic device, for moving the locking member from the unlocked position to the locked position and for holding the locking member in the locked position in response to the second signal.

This apparatus is operative to maintain the locking member in a locked position and thereby prevent the gun from firing when the level of incapacity of the person intending to use the gun is excessive for safe use of the gun.

In still another embodiment, the apparatus includes a testing device for determining if a person intending to use a gun is upset or angry. This testing device may include a device for checking the temperature and/or sweat on a body part and/or checking the person's blood pressure, blood oxygen level or the like, as indicators of a level of anger. When the logic device determines the level is excessive, it produces a signal indicating such level of anger.

In this embodiment, the apparatus maintains the locking member in a locked position and prevents the gun from firing as long as the level of anger of the person intending to use the gun exceeds an acceptable level for safe use of the gun.

Finally, in still another embodiment of the present invention, a gun key device, which is preferably a smartphone, includes a microphone and operates to detect voice commands or messages that are spoken into the microphone. The authorized user of the gun is prompted to enter a certain override command or "secret word" or phrase which, when later spoken in the event of an emergency, immediately unlocks the gun and enables the gun to be fired. By way of an example but not limitation, a gun owner could say "nine-one-one" if he or she found that someone were breaking and entering his/her home. If this phrase were the "secret word," the smartphone would not only call this emergency number but it would also override all security measures and unlock the gun for use against the intruder.

In this embodiment, the apparatus preferably comprises;

(1) a gun lock configured to be installed on a gun and which includes:

(a) an electric gun lock device configured to be disposed on a gun and responsive to at least one electric signal to select between two operative states, a locked state which prevents firing the gun and an unlocked state which enables firing;

(b) a wireless data receiver for receiving a gun unlock data signal representing first gun unlock data;

(c) a data memory for storing second gun unlock data; and (d) a first logic device, coupled to the data receiver and to the data memory, for comparing the first gun unlock data received by the receiver with the second gun unlock data stored in the memory upon receipt of the gun unlock signal, and for producing the at least one electric signal to select the unlocked state in dependence upon whether the first gun unlock data and the second gun unlock data are substantially the same; and (2) a gun key device for unlocking the gun formed by a smartphone including:

(a) a wireless data transmitter for transmitting a data signal representing the first gun unlock data to the data receiver;

(b) a first input device comprising a camera for inputting personal information from a putative authorized person who wishes to unlock the gun, the personal information including at least one biologic identifying image of a bodily aspect of the putative authorized person;

(c) a second input device comprising a microphone for inputting a voice command; and (d) a second logic device, coupled to the short-range transmitter and to each of the first and the second input device, for generating the first gun unlock data from the personal information and from the voice command for transmission to the data receiver via the data transmitter;

wherein the first logic device is operative to cause the gun lock device to enable the gun to be fired when the first gun unlock data received by the data receiver are substantially the same as the second gun unlock data stored in the data memory, and enable the gun to be fired when a voice command, spoken into the microphone, includes a certain word preselected by the authorized user.

The gun is unlocked when (1) the putative authorized person is recognized as an authorized person only in the event that the first gun unlock data transmitted by the gun key device substantially matches the second gun unlock data stored in the data memory, or (2) the preselected word is spoken into the microphone and is detected by one of the first and second logic device, thereby enabling the gun to be fired in the case of an emergency.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
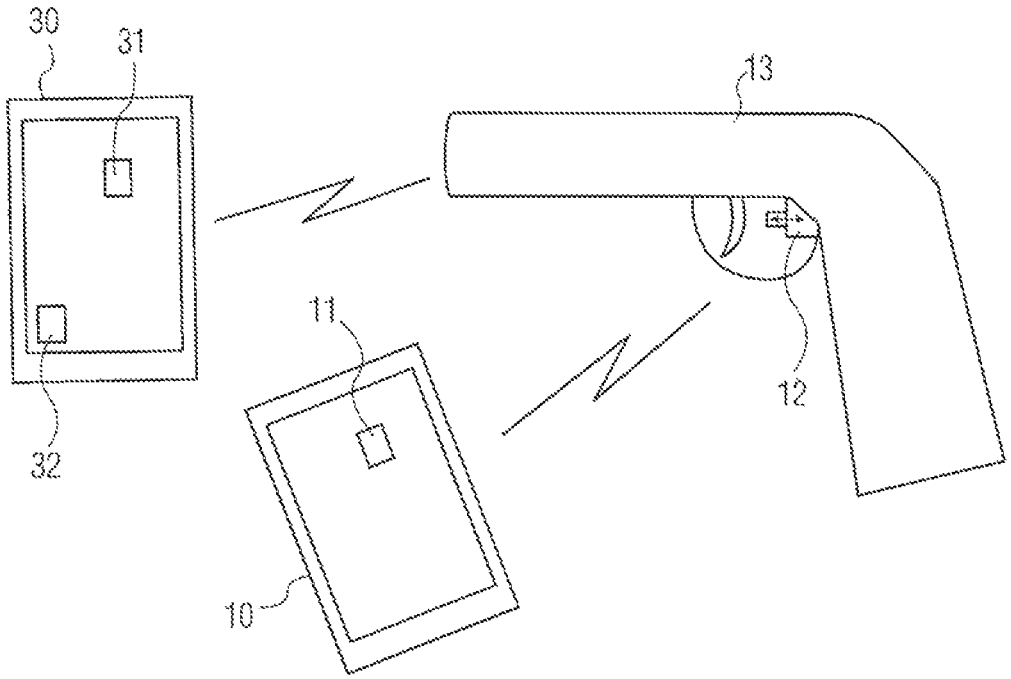
FIG. 1 is a representational diagram showing a smartphone and a gun that is equipped with a gun lock according to the present invention.

The preferred embodiments of the present invention will now be described with reference to FIGS. 1-5 of the drawings. Identical elements in the various figures are identified with the same reference numerals.

Briefly in overview, a battery-operated gun-locking device is permanently attached to, or installed on and incorporated into a gun. For example a trigger lock may be installed in a recess behind the trigger or in the lower receiver mechanism of the gun. In its default condition, a movable member is in a forward position, blocking rearward movement of the trigger. When unlocked, the movable member is drawn rearward to allow movement of the trigger.

The gun-locking device has a Bluetooth or other type of wireless receiver and a memory with stored security data. When data matching this stored data is received from a smartphone or similar device, the gun-locking device enables the gun to fire. Otherwise the gun is locked against firing.

FIG. 1 illustrates this configuration. A smartphone 10 has an app that presents a screen button 11 called "Gun Lock" for each gun the smartphone owner owns or is licensed to use. By pressing this button on the app, the owner sends a password, a pseudo-random number or biologic ID security data by a Bluetooth wireless connection to a locking and unlocking device 12 installed permanently in a gun 13.

The smartphone 10 has a microphone which is used for voice communication. This microphone can be used to unlock the gun in an emergency situation when the owner feels threatened. By speaking a "secret word" or phrase known only to the owner of the gun, the owner can override and bypass the gun security features provided by the gun lock app. This is effected by detecting the word or phrase, either by an algorithm in the smartphone 10 or in the gun trigger lock itself, by transmission via Bluetooth, and once detected, unlocking the trigger lock.

One or more additional smartphones 30 have an app that presents a screen button 31 called "Gun Lock" that may be used to lock and/or unlock a particular gun (using the password, a pseudo-random number or biologic ID security data) or, as a master key, to lock all guns in the vicinity of the Bluetooth connection. Like the smartphone 10, this smartphone 30 may have a GPS locater 32 that causes the app to automatically send out a signal to lock the gun(s) whenever the smartphone 30 senses that the gun 13, or any other gun, is within its Bluetooth connection area. In this way, the gun 13 (and/or any other gun) may be locked against firing when in the vicinity of a school or any other area where the firing of guns is prohibited.

Alternatively or in addition, the GPS locater may be disposed on the gun itself to automatically lock the gun: (1) when it is within a prescribed geographical area or (2) when it is within a prescribed distance from a certain person who is protected by a court order against possible violence by the gun owner or user. In the latter case, the protected person carries the smartphone 30 with the GPS locater. The logic device within the gun lock compares the GPS location of the gun with the GPS location of the smartphone 30, transmitted to the gun for example by Bluetooth, and causes the gun lock 12 to operate to prevent the gun from firing when the two locations are within a prescribed distance from each other.

Figure 2:
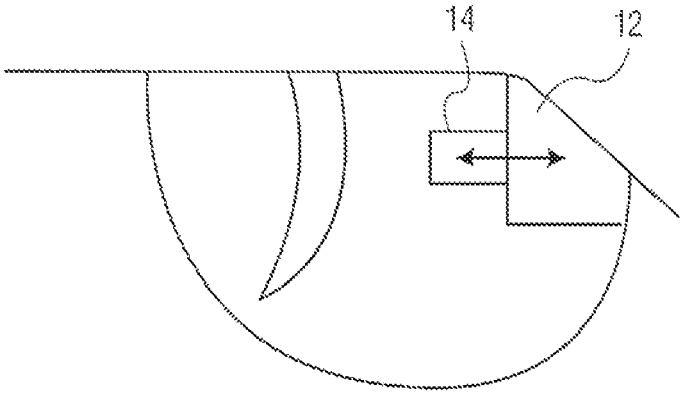
FIG. 2 is a close-up view of the trigger region of the gun of FIG. 1 with the gun lock installed.

FIG. 2 shows a trigger-locking device 12 with a movable member 14, which may be used as a gun locking device. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security App may use face recognition or iris recognition software to identify the owner from the camera image.

When the gun locking device 12 is first used, the smartphone app can generate a pseudo-random number and send it to the gun locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the gun locking device releases the lock so the gun may be fired. Before sending the unlock number, the user of the smartphone may be required to identify himself/herself by entering biologic identifying information into the phone for a recognition algorithm. Alternatively, the biologic ID information may be sent to the gun locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identity with the smartphone; and (2) Press the Gun Unlock button to enable the gun lock to be released.

The gun remains unlocked until the gun user presses another button on the smartphone app, appropriately called "Gun Lock," or until the gun lock times out and automatically locks itself by restoring the gun lock to the locked position.

The gun locking device 12 is preferably powered by a replaceable and/or rechargeable battery (not shown).

Figure 3:
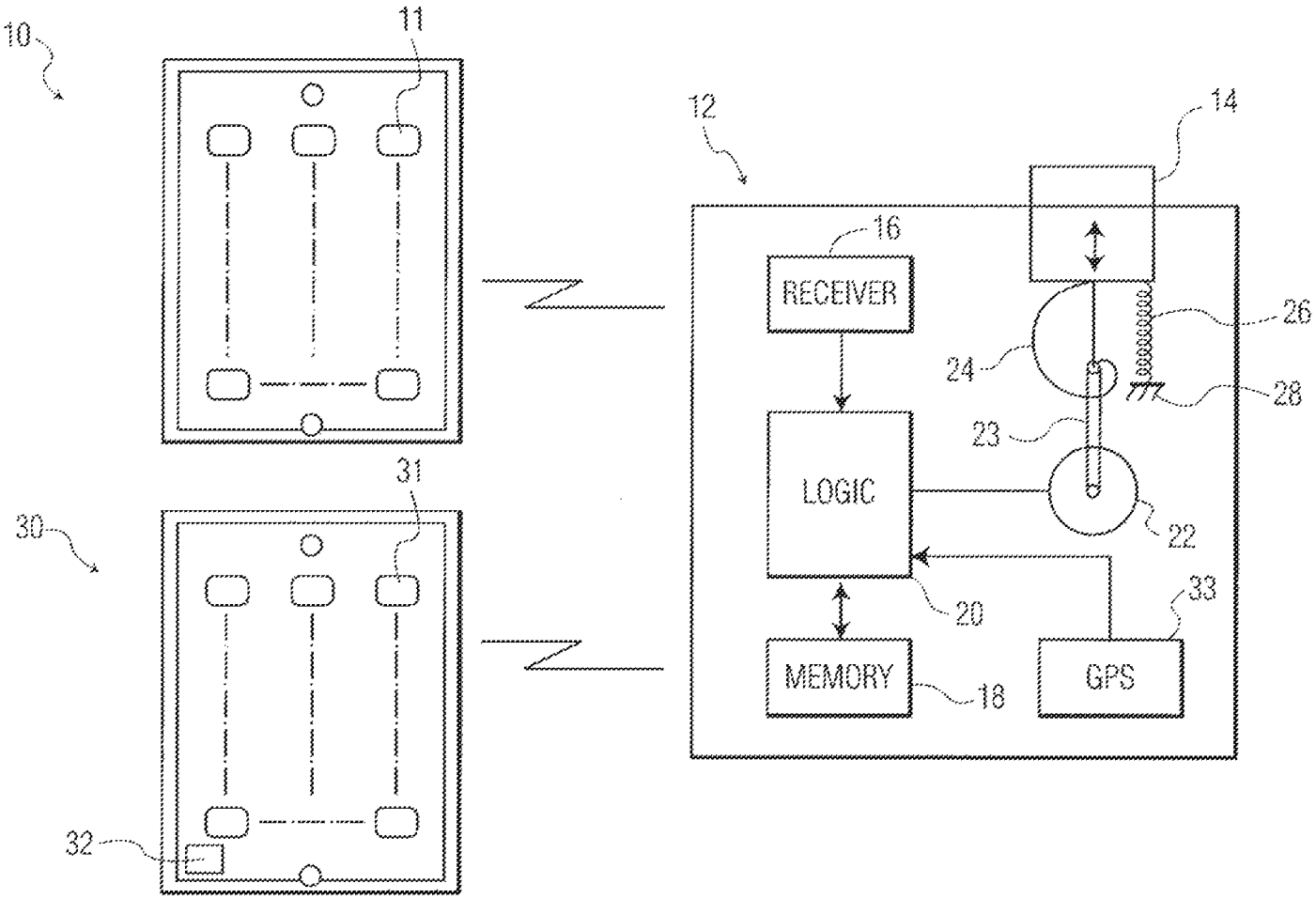
FIG. 3 is a block diagram showing a first preferred embodiment of the gun lock according to the present invention.

FIG. 3 shows the individual elements of the gun lock apparatus. The smartphone 10 transmits to a receiver 16 in the gun locking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone 10 is indeed the owner of the gun. Once the right to use the gun has been established, the user of the smartphone 10 can unlock (and, if desired, also lock) the gun.

Similarly, the second smartphone 30 may send a signal to the gun locking device to either to lock or unlock the gun. This smartphone 30 may also be used as a master key, by police for example, and transmit a data packet that matches data stored in all guns and can therefore control (lock and unlock) all guns.

The smartphone 30 may also have a GPS locater 32 and responsive software which automatically sends out a gun locking signal whenever the Bluetooth connection has been established with a particular gun (matched by the security data) or with all guns in the vicinity (by master key operation as explained above).

According to another embodiment of the invention, the gun locking device itself may include a GPS locater and software that runs in the logic device 20, which automatically causes the gun to lock when it is brought into a proscribed geographical area, such as within a school or other public building or without an airport or shopping mall.

According to another embodiment of the invention, the smartphone 10 may be configured to be attachable to, or may be permanently incorporated into, the gun 13, for example on or in the handle grip.

Figure 4:
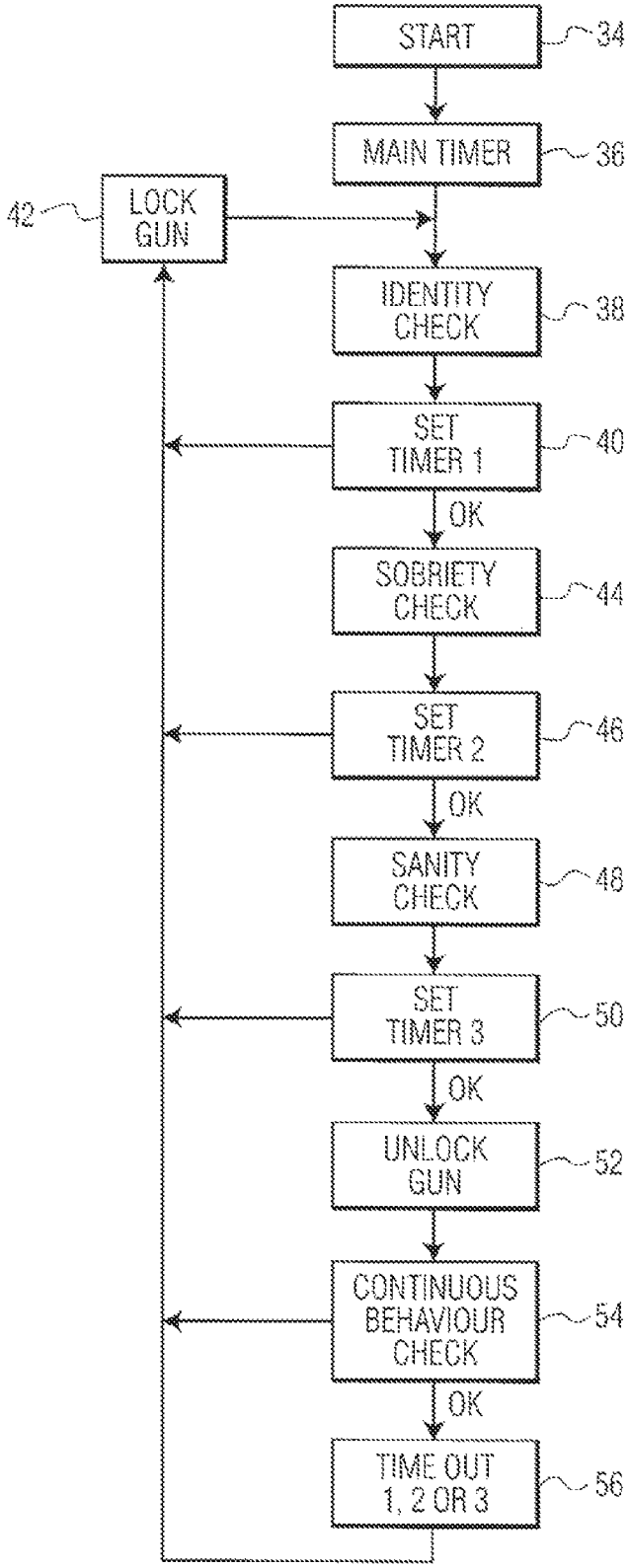
FIG. 4 is a flow chart showing the operation of a smartphone application ("App") according to a second preferred embodiment of the present invention.

FIG. 4 is a flow chart of an algorithm for the app that may be used with the smartphone 10 to ensure that the owner, or any other person who is authorized to use the gun, can use the gun only when it is proper to do so.

When the owner or other authorized person wishes to use the gun, he/she must plan ahead. After the button 11 for gun lock app is initially pressed on the smartphone 10 the algorithm starts at 34 and immediately sets a main timer 36. Only after this timer times out (for example, after an hour, several hours or even a day) does the app allow the gun to be used at all. This initial period prevents the gun from being used except when the owner or authorized person has planned to do so in advance. The smartphone 10 could be programmed to register, and possibly obtain clearance for, the use of the gun with a third party, such as the police, by automatically placing a phone call to the third party during this "blackout period."

Upon the expiration of the time period set in the main timer 36, the app carries out an identity check 38 of the gun user by bio-identification using a camera (e.g. for face, fingerprint or iris recognition), or a microphone (for voice ID). Following this identity check, a first timer 38 is set. If gun owner or other authorized person is not properly identified, the app transfers control to the gun lock 42 which maintains gun in the locked state until the first timer 38 times out. If the gun user is properly identified the app carries out a sobriety check 44, for example by means of a breathalyzer unit plugged into the smartphone 10, and sets a second timer 46. Depending upon the level of intoxication (if any) detected by the breathalyzer, the timer can be set to expire at a time when the user is expected to again reach sobriety. Assuming the user passes the sobriety check, the app conducts a sanity check 48, for example by requiring the user to answer a number of oral or written questions to determine whether the user is acting rationally. The app then sets a third timer 50 before continuing. Assuming the smartphone user answers the questions appropriately and is otherwise authorized or licensed to use the gun, the smartphone unlocks the gun at 52. During use of the gun, the app can continue to monitor the user's behavior at 54 and cause the gun to be locked if inappropriate or irrational behavior is detected. Such behavior may include, for example, angry, inappropriate or irrational comments heard by the smartphone microphone. Finally, if any one of the first, second or third timers times out at 56 the app again causes the gun to be locked at 42.

Figure 5:
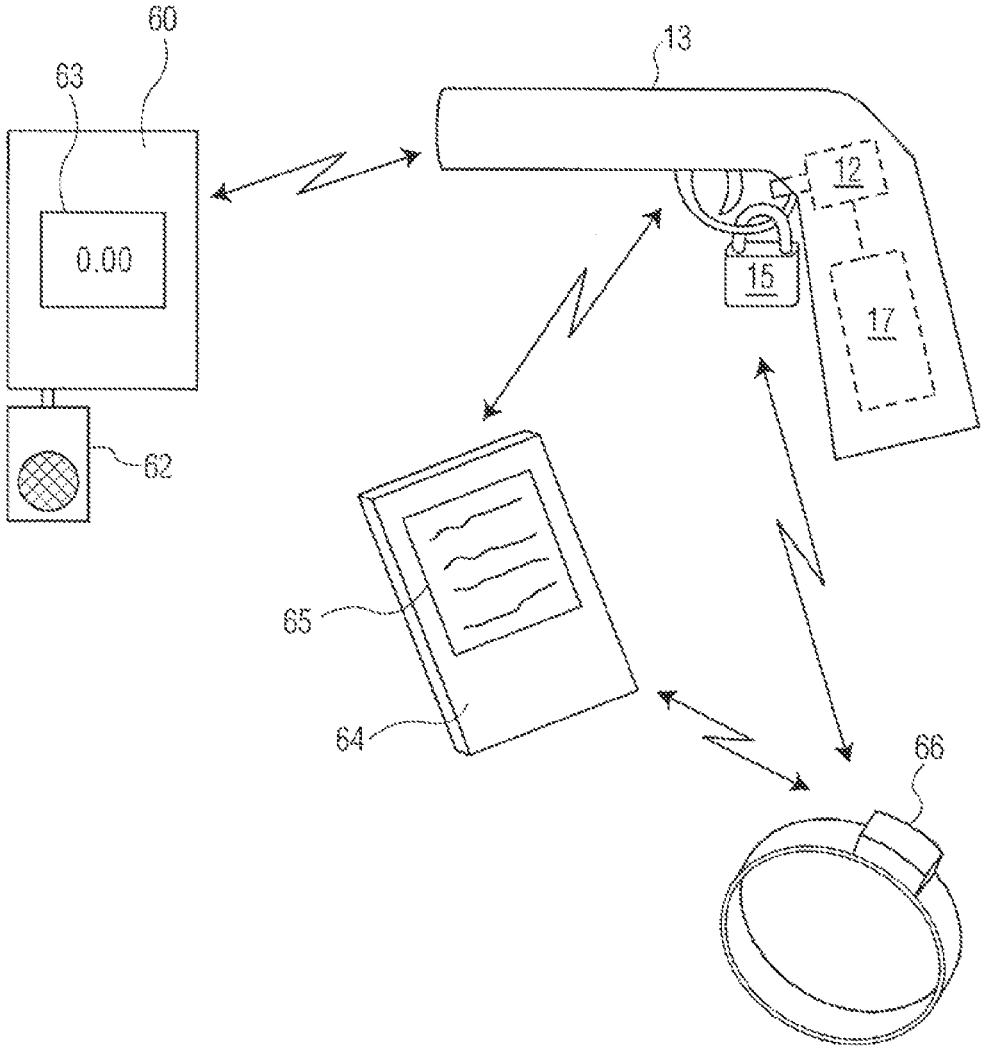
FIG. 5 is a block diagram showing an exemplary embodiment of the apparatus, according to the invention, which includes two Apple iPhones and an Apple watch.

FIG. 5 shows a handgun 13 having an internal mechanical gun lock 12 with a movable member 14 controlled by a battery-operated electronic device 17 built into the gun handle. The gun lock can also take the form of a padlock 15 which is installed manually by the user and incorporates the same mechanical and electrical elements as the gun lock 12.

The gun locks 12 or 15 are controlled by smartphones 60 and 64, such as the Apple iPhones shown, as well as by a smart watch 66, such as the Apple watch.

In this embodiment, a breathalyzer device 62 is plugged into the earphone jack of the smartphone 60. The smartphone 60 receives an electronic signal representing the level of intoxication and displays this level on its screen 63.

The smartphone 64 receives medical data, such as blood pressure, blood oxygen level and/or the sweat and/or temperature of a body part, from the smart watch 66 and displays this data on its screen 65. The smartphone analyzes the medical data and transmits an unlock signal to the gun only if the person wishing to unlock the gun exhibits an appropriate level of sobriety, competency and calmness of demeanor. The smartphone 64 can also actively query the gun user who must respond appropriately for the smartphone to unlock the gun.

There has thus been shown and described a novel secure smartphone-operated gun lock which fulfills all the objects and advantages sought therefor. Many changes, variations and other uses and applications of the subject invention will become apparent to those skilled in the art after considering this specification and the accompanying drawings. All such changes, variations and other uses and applications which do not depart from the spirit and scope of the invention are deemed to be covered by the claims that follow.

What is claimed is:

1. Apparatus for preventing a gun from firing under certain circumstances, said apparatus comprising, in combination:

(a) a gun having a first source of electrical power and comprising the following components coupled to said first of power:

(1) a gun lock mechanism, responsive to a gun command signal, for preventing firing of the gun when in a locked state and enabling firing of the gun when in an unlocked state;

(2) a wireless receiving ("R") device for receiving a gun information signal from a wireless transmitting ("T") device;

(3) a first digital logic device, coupled to said R device and to said gun lock mechanism, for receiving said gun information signal and for producing said gun command signal in response thereto to set said gun lock mechanism in either said locked state or said unlocked state; and (4) a digital data memory, coupled to said device, for storing first gun unlock data representing biologic identifying data of a person authorized to fire the gun; and (b) a portable smartphone having a second source of electrical power and comprising the following components coupled to said second source of power:

(1) a wireless transmitting ("T") device for transmitting said gun information signal to said R device;

(2) a first GPS locator device for determining the geographic location of said smartphone;

(3) a second digital logic device, coupled to said T device and to said first GPS locator device, for producing said gun information signal representing instructions for use of the gun; and (4) an input device, coupled to said second logic device, for inputting personal information from a putative authorized person who wishes to unlock and fire the gun, said personal information including biologic data identifying a bodily aspect of said putative authorized person;

wherein said smartphone includes a phone a operative (1) to cause said second logic device to generate second gun unlock data from said personal information for transmission by said T device to said R device, and (2) to cause said second logic device to produce said gun information for transmission by said T device to said R device, said gun information signal representing a command to set said gun lock mechanism in the locked state, to prevent firing of the gun, whenever said smartphone is in a proscribed area; and wherein said first logic device is operative (1) to set said gun lock mechanism in the unlocked state and enable the gun to be fired when the second gun unlock data received by said R device are substantially the same as the first gun unlock data stored in said data memory, and (2) to set said gun lock mechanism in the locked state and prevent firing of the gun when said smartphone is in a prescribed area;

whereby said first logic device is operative to enable the gun to be fired when the second gun unlock data received by said R device are substantially the same as the first gun unlock data stored in the data memory, except when said smartphone is in said proscribed area.

2. The gun lock apparatus of claim 1, wherein said input device includes a camera for producing a biologic identifying image of a bodily aspect of said putative authorized person.

3. The apparatus defined in claim 1, wherein said bodily aspect of said putative authorized person is selected from the group consisting of:

a facial image;

an image of an iris;

a retinal image;

a fingerprint;

a palm print; and an image of veins a hand;

and wherein said second logic device is operative to process said image and to generate said first gun unlock data therefrom.

* * * * *